US012403561B2

(12) United States Patent
Xu et al.

(10) Patent No.: US 12,403,561 B2
(45) Date of Patent: Sep. 2, 2025

(54) EDDY CURRENT MONITORING TO DETECT VIBRATION IN POLISHING

(71) Applicant: Applied Materials, Inc., Santa Clara, CA (US)

(72) Inventors: Kun Xu, Sunol, CA (US); Patrick A. Higashi, Hacienda Heights, CA (US); Hassan G. Iravani, Sunnyvale, CA (US); Harry Q. Lee, Los Altos, CA (US); Haosheng Wu, San Jose, CA (US); Eric T. Wu, Milpitas, CA (US); Ningzhuo Cui, Santa Clara, CA (US); Jeonghoon Oh, Saratoga, CA (US); Christopher Lai, Santa Clara, CA (US); Jun Qian, Sunnyvale, CA (US)

(73) Assignee: Applied Materials, Inc., Santa Clara, CA (US)

( * ) Notice: Subject to any disclaimer, the term of this patent is extended or adjusted under 35 U.S.C. 154(b) by 474 days.

(21) Appl. No.: 17/691,101

(22) Filed: Mar. 9, 2022

(65) Prior Publication Data

US 2023/0286107 A1 Sep. 14, 2023

(51) Int. Cl.

| | |
|---|---|
| ***B24B 49/10*** | (2006.01) |
| ***B24B 37/005*** | (2012.01) |
| ***B24B 37/26*** | (2012.01) |

(52) U.S. Cl.

CPC ..... *B24B 49/105* (2013.01); *B24B 37/005* (2013.01); *B24B 37/26* (2013.01)

(58) Field of Classification Search

None

See application file for complete search history.

(56) References Cited

U.S. PATENT DOCUMENTS

| | | | | |
|---|---|---|---|---|
| 6,975,107 | B2 | 12/2005 | Hanawa et al. | |
| 7,112,960 | B2 | 9/2006 | Miller et al. | |
| 7,264,537 | B1 * | 9/2007 | Laursen | B24B 37/013 451/6 |
| 2005/0054268 | A1 | 3/2005 | Kistler et al. | |
| 2010/0099334 | A1 | 4/2010 | Bennett et al. | |
| 2013/0044004 | A1 | 2/2013 | Hwang et al. | |

(Continued)

FOREIGN PATENT DOCUMENTS

| | | |
|---|---|---|
| EP | 2614922 | 4/2016 |
| JP | 2010-036299 | 2/2010 |

(Continued)

OTHER PUBLICATIONS

International Search Report and Written Opinion in International Appln. No. PCT/US2022/073966, mailed on Dec. 5, 2022, 9 pages.

(Continued)

*Primary Examiner* — Monica S Carter
*Assistant Examiner* — Jonathan R Zaworski
(74) *Attorney, Agent, or Firm* — Fish & Richardson P.C.

(57) ABSTRACT

A body is brought into contact with a polishing pad of a polishing system, a polishing liquid is supplied to the polishing pad, relative motion between the body and the polishing pad is generated while the body contacts the polishing pad, a signal from an in-situ eddy current monitoring system during the relative motion while the body contacts the polishing pad, generating, and mechanical vibrations in the polishing system are detected based on a signal from the in-situ eddy current monitoring system.

5 Claims, 5 Drawing Sheets

(56) References Cited

U.S. PATENT DOCUMENTS

| | | | | |
|---|---|---|---|---|
| 2013/0065493 | A1* | 3/2013 | Takahashi | B24B 49/105 451/259 |
| 2014/0141695 | A1 | 5/2014 | David et al. | |
| 2014/0329439 | A1 | 11/2014 | Chew et al. | |
| 2016/0099156 | A1 | 4/2016 | Yamaguchi et al. | |
| 2016/0158908 | A1 | 6/2016 | Xu et al. | |
| 2018/0056476 | A1 | 3/2018 | Zhang et al. | |
| 2019/0283204 | A1* | 9/2019 | Swedek | B24B 37/105 |
| 2020/0039019 | A1 | 2/2020 | Hwang et al. | |

FOREIGN PATENT DOCUMENTS

| | | | |
|---|---|---|---|
| KR | 10-1105264 | | 1/2012 |
| KR | 10-2017-0125382 | | 11/2017 |
| KR | 10-2021-0012043 | | 2/2021 |
| TW | 201422375 | A | 6/2014 |
| TW | 202006858 | A | 2/2020 |
| TW | 202007481 | A | 2/2020 |

OTHER PUBLICATIONS

Office Action in Taiwanese Appln. No. 111127540, dated Aug. 25, 2023, 19 pages (with English summary).

Office Action in Korean Appln. No. 10-2024-7033226, mailed on Apr. 29, 2025, 23 pages (with English translation).

* cited by examiner

EDDY CURRENT MONITORING TO DETECT VIBRATION IN POLISHING

TECHNICAL FIELD

The present disclosure relates to chemical mechanical polishing, and more specifically to eddy current monitoring during polishing.

BACKGROUND

An integrated circuit is typically formed on a substrate by the sequential deposition of conductive, semiconductive, or insulative layers on a silicon wafer. A variety of fabrication processes require planarization of a layer on the substrate. For example, one fabrication step involves depositing a filler layer over a non-planar surface and planarizing the filler layer. For certain applications, the filler layer is planarized until the top surface of a patterned layer is exposed. For example, a metal layer can be deposited on a patterned insulative layer to fill the trenches and holes in the insulative layer. After planarization, the remaining portions of the metal in the trenches and holes of the patterned layer form vias, plugs, and lines to provide conductive paths between thin film circuits on the substrate.

Chemical mechanical polishing (CMP) is one accepted method of planarization. This planarization method typically requires that the substrate be mounted on a carrier head. The exposed surface of the substrate is typically placed against a rotating polishing pad. The carrier head provides a controllable load on the substrate to push it against the polishing pad. Polishing slurry with abrasive particles is typically supplied to the surface of the polishing pad.

In some systems, a substrate is monitored in-situ during polishing, e.g., through the polishing pad. One monitoring technique is to induce an eddy current in the conductive layer of the substrate and detect the change in the eddy current as the conductive layer is removed.

SUMMARY

In one aspect of a method, computer program product or polishing system, a signal is generated from an in-situ eddy current monitoring system during relative motion of a body that contacts the polishing pad, and mechanical vibrations in the polishing system are detected based on a signal from the in-situ eddy current monitoring system.

In another aspect, a method of chemical mechanical polishing includes bringing a substrate into contact with a polishing pad, supplying a polishing liquid to the polishing pad, generating relative motion between the substrate and the polishing pad, during polishing of the substrate sweeping a sensor of an in-situ eddy current monitoring system in a path that crosses the substrate, selecting portions of a signal from the in-situ eddy current monitoring system that correspond to off-metal positions of the sensor with the off-metal positions excluding at least positions that are below the substrate, measuring noise in the selected portions of the signal that correspond to the off-metal positions of the sensor, and comparing the measured noise to a threshold value to determine whether to generate an alert.

In another aspect, a computer program product tangibly encoded on a non-transitory computer readable media has instructions to cause one or more computers to receive a signal from an in-situ eddy current monitoring system that includes a sensor that sweeps below a carrier head of a polishing system, select portions of the signal that correspond to off-metal positions of the sensor with the off-metal positions excluding at least positions of the sensor that are below the carrier head, measure noise in the selected portions of the signal that correspond to the off-metal positions of the sensor, and compare the measured noise to a threshold value to determine whether to generate an alert.

In another aspect, a polishing system includes a rotatable platen to hold a polishing pad, a carrier head to hold a substrate in contact with the polishing pad, a motor to rotate the platen, an in-situ eddy current monitoring system including a sensor positioned in the platen such that the sensor sweeps beneath the carrier head with each rotation of the platen, and a controller. The controller is configured to receive a signal from the in-situ eddy current monitoring system, select portions of the signal that correspond to off-metal positions of the sensor with the off-metal positions excluding at least positions of the sensor that are below the carrier head, measure noise in the selected portions of the signal that correspond to the off-metal positions of the sensor, and compare the measured noise to a threshold value to determine whether to generate an alert.

Implementations may include one or more of the following advantages. The onset of vibration in the polishing system can be detected, and an alert can be generated to halt polishing or take corrective action. Damage to an inner surface of the retaining ring, e.g., inner diameter grooving, can be reduced or avoided. Edge overpolishing can be reduced, thus increasing yield. Polishing processes and hardware can be screened to ensure that they do not provide in this vibration. The detection can be implemented with existing hardware, e.g., existing eddy current monitoring systems, thus enabling a low cost solution.

The details of one or more implementations are set forth in the accompanying drawings and the description below. Other aspects, features, and advantages will be apparent from the description and drawings, and from the claims.

DETAILED DESCRIPTION

One problem that can occur in chemical mechanical polishing is non-uniform polishing, e.g., over-polishing of the substrate edge (typically considered the outer 5-10 mm of the substrate). Damage to the inner diameter surface of the retaining ring, e.g., scratching or grooving forming on the inner diameter surface, may be correlated with some instances of non-uniform polishing. Without being limited to theory, it is hypothesized that certain polishing conditions result in high friction and stiction between the polishing pad and the substrate and/or retaining ring. This high friction is theorized to result in the substrate and/or retaining ring being subject to a slip-stick motion (rather than relatively uniform motion) when passing over the polishing pad. In particular, it is hypothesized that the slip-stick motion results in vibration of the substrate relative to the retaining ring, which can cause the substrate edge to gouge into and damage the inner surface of the retaining ring, leaving scratches or grooving. The non-uniform inner surface of the ring in turn causes non-uniform polishing, e.g., overpolishing at the substrate edge.

Still without being limited to theory, this slip-stick effect may be more likely to occur in "aggressive" polishing operations, e.g., combinations of low slurry flow rates, high temperatures, and high pressures. Such aggressive polishing may be needed for polishing for planarization of certain materials or to achieve high polishing rates. In some instances, aggressive polishing can be performed without the associated retaining ring damage and non-uniform polishing. However, non-uniform polishing can rapidly develop after polishing of multiple substrates normally. Again hypothesizing, in aggressive polishing operations even small shifts in temperature, slurry distribution, etc., may be sufficient to initiate the onset of the slip-stick effect. Unfortunately, this slip-stick effect is not immediately apparent to many monitoring techniques, e.g., motor torque monitoring. Moreover, due to the combination and contribution of other variables, e.g., pad roughness, slurry viscosity, etc., it may not be possible to designate certain parameters such as platen motor torque, carrier head torque, or pad temperature as a boundary at which the slip-stick effect occurs.

However, the slip-stick effect does result in vibratory energy being transmitted into the polishing system. In particular, an eddy current monitoring system can be used to detect mechanical vibration in the polishing system, e.g., resulting from the slip-stick effect. This permits generation of an alert or modification of operating parameters to avoid damage to the retaining ring.

Figure 1:
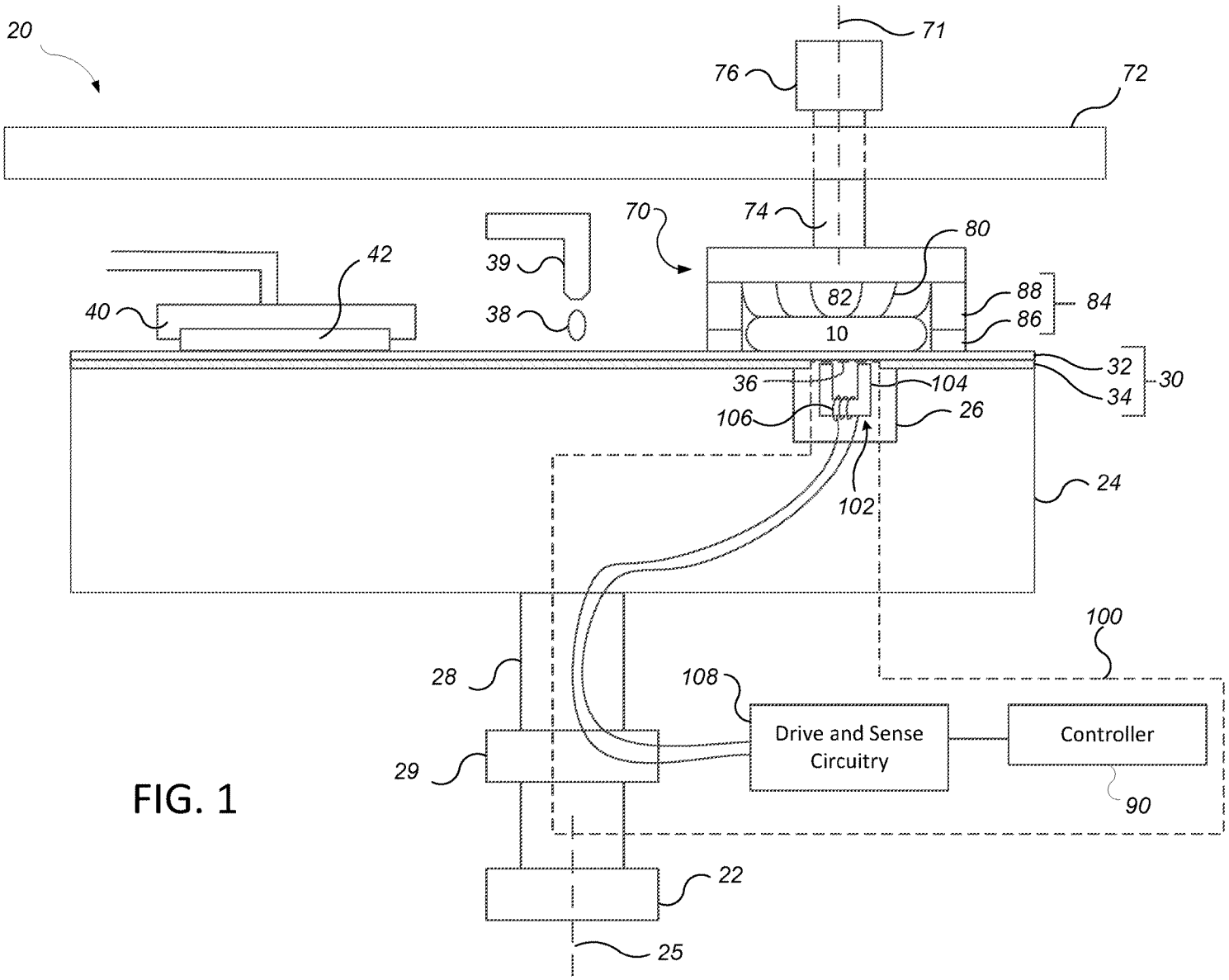
FIG. 1 illustrates a schematic cross-sectional view of an example of a polishing station including an eddy current monitoring system.
Figure 2:
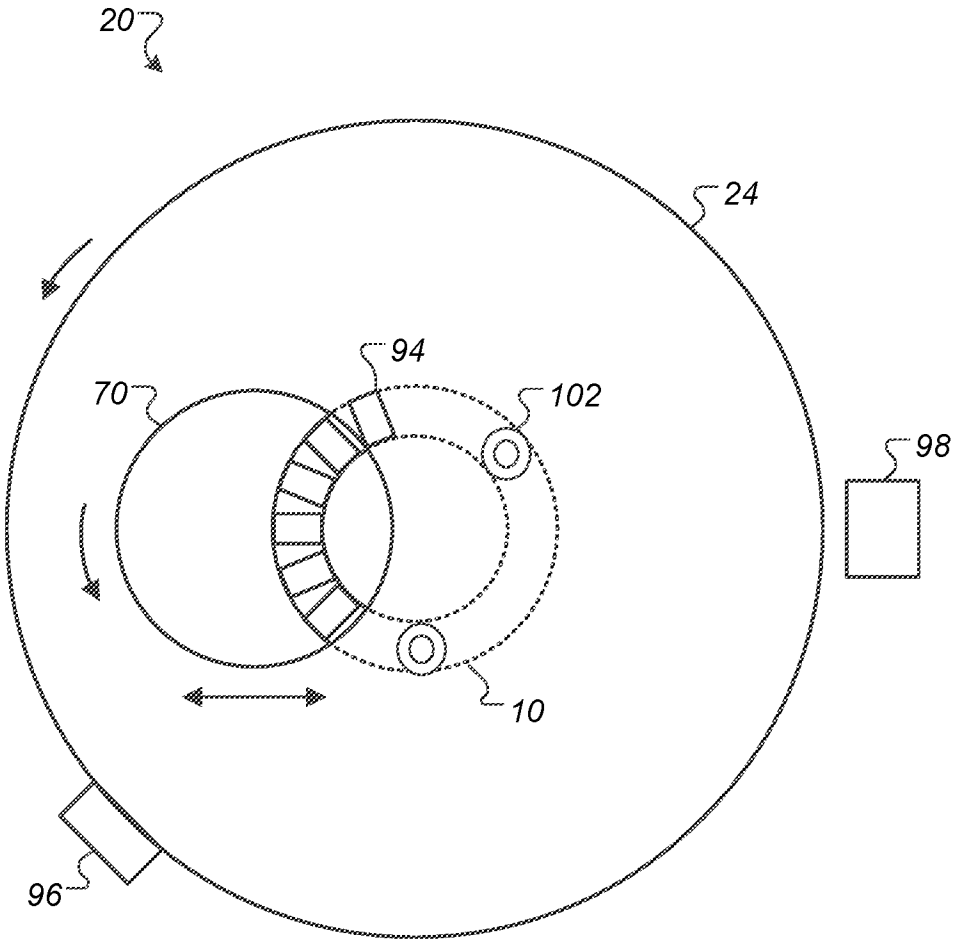
FIG. 2 illustrates a schematic top view of an example chemical mechanical polishing station showing a path of a sensor scan across a substrate.

FIGS. 1 and 2 illustrate an example of a polishing station 20 of a chemical mechanical polishing system. The polishing station 20 includes a rotatable disk-shaped platen 24 on which a polishing pad 30 is situated. The platen 24 is operable to rotate about an axis 25. For example, a motor 22 can turn a drive shaft 28 to rotate the platen 24. The polishing pad 30 can be a two-layer polishing pad with an outer polishing layer 34 and a softer backing layer 32.

The polishing station 20 can include a supply port or a combined supply-rinse arm 39 to dispense a polishing liquid 38, such as an abrasive slurry, onto the polishing pad 30. The polishing station 20 can include a pad conditioner apparatus such as a conditioner head 40 with a conditioning disk 42 to maintain the surface roughness of the polishing pad.

A carrier head 70 is operable to hold a substrate 10 against the polishing pad 30. The carrier head 70 is suspended from a support structure 72, e.g., a carousel or a track, and is connected by a drive shaft 74 to a carrier head rotation motor 76 so that the carrier head can rotate about an axis 71. Optionally, the carrier head 70 can oscillate laterally, e.g., on sliders on the carousel, by movement along the track, or by rotational oscillation of the carousel itself.

The carrier head 70 can include a retaining ring 84 to hold the substrate. In some implementations, the retaining ring 84 may include a highly conductive portion, e.g., the retaining ring can include a thin lower plastic portion 86 that contacts the polishing pad, and a thick upper conductive portion 88. In some implementations, the highly conductive portion is a metal, e.g., the same metal as the layer being polished, e.g., copper.

In operation, the platen is rotated about its central axis 25, and the carrier head is rotated about its central axis 71 and translated laterally across the top surface of the polishing pad 30. The carrier head 70 can include a flexible membrane 80 having a substrate mounting surface to contact the back side of the substrate 10, and a plurality of pressurizable chambers 82 to apply different pressures to different zones, e.g., different radial zones, on the substrate 10. The carrier head can also include a retaining ring 84 to hold the substrate.

The polishing system also includes an eddy current monitoring system 100 which can be coupled to or be considered to include a controller 90. A rotary coupler 29 can be used to electrically connect components in the rotatable platen 24, e.g., the sensors of the in-situ monitoring systems, to components outside the platen, e.g., drive and sense circuitry or the controller 90.

The in-situ eddy current monitoring system 100 is configured to generate a signal that depends on a depth of a layer of conductive material, e.g., a metal such as copper, on the substrate. In operation, the polishing system can use the in-situ monitoring system 100 to determine when the conductive layer has reached a target thickness, e.g., a target depth for metal in a trench or a target thickness for a metal layer overlying the dielectric layer, and then halts polishing. Alternatively or in addition, the polishing system can use the in-situ monitoring system 100 to determine differences in thickness of the conductive material 16 across the substrate 10, and use this information to adjust the pressure in one or more chambers 82 in the carrier head 70 during polishing in order to reduce polishing non-uniformity.

A recess 26 can be formed in the platen 24, and optionally a thin section 36 can be formed in the polishing pad 30 overlying the recess 26. The recess 26 and thin section 36 can be positioned such that regardless of the translational position of the carrier head they pass beneath substrate 10 during a portion of the platen rotation. Assuming that the polishing pad 30 is a two-layer pad, the thin section 36 can be constructed by removing a portion of the backing layer 32, and optionally by forming a recess in the bottom of the polishing layer 34. The thin section can optionally be optically transmissive, e.g., if an in-situ optical monitoring system is integrated into the platen 24.

The in-situ monitoring system 100 can include a sensor 102 installed in the recess 26. The sensor 102 can include a magnetic core 104 positioned at least partially in the recess 26, and at least one coil 106 wound around a portion of the core 104. Drive and sense circuitry 108 is electrically connected to the coil 106. The drive and sense circuitry 108 generates a signal that can be sent to the controller 90. Although illustrated as outside the platen 24, some or all of the drive and sense circuitry 108 can be installed in the platen 24.

Figure 3:
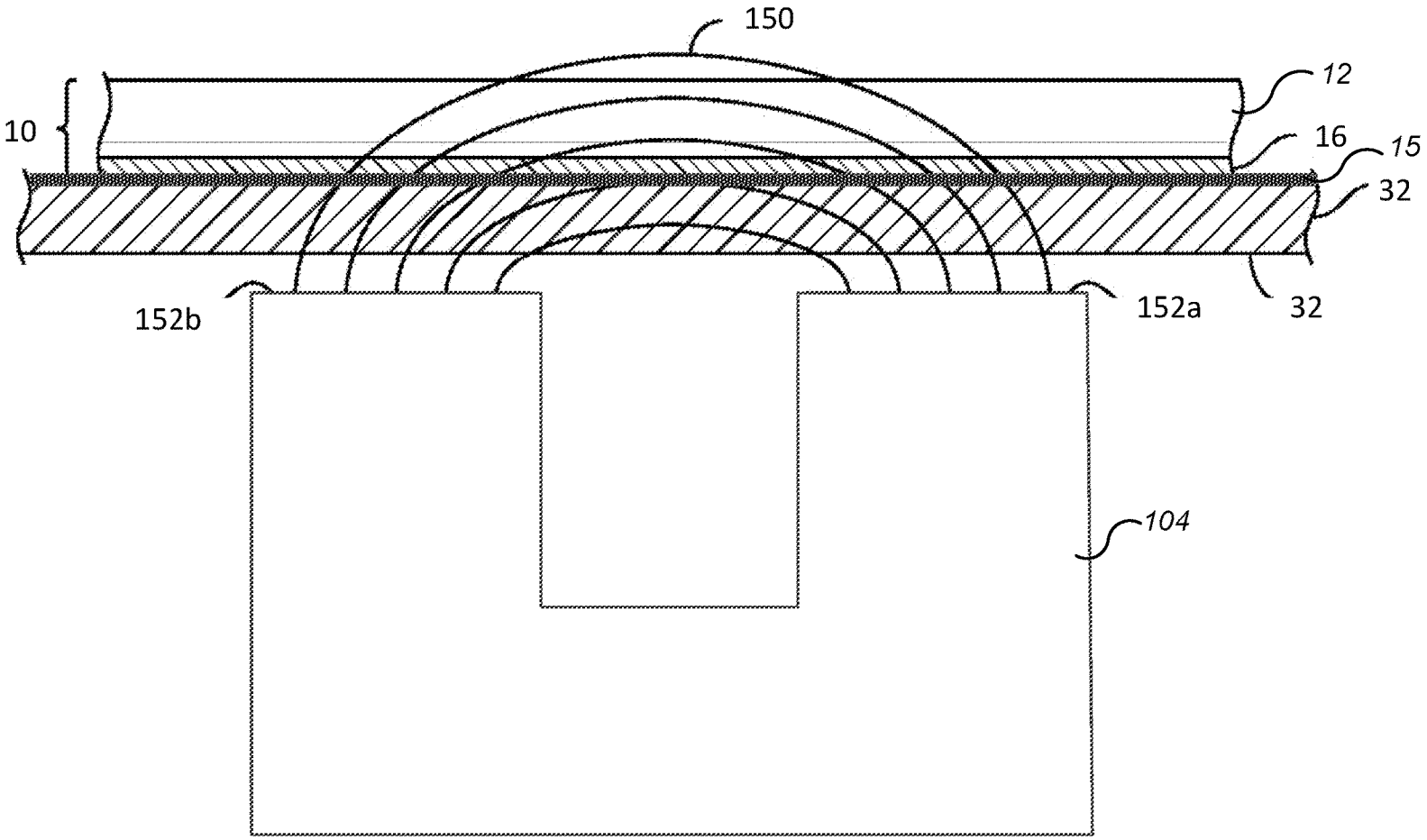
FIG. 3 is a schematic cross-sectional view illustrating an example magnetic field generated by a sensor of an eddy current monitoring system.

Referring to FIGS. 1 and 3, the drive and sense circuitry 108 applies an AC current to the coil 106, which generates a magnetic field 150 between two poles 152*a* and 152*b* of the core 104. In operation, when the substrate 10 intermittently overlies the sensor 102, a portion of the magnetic field 150 extends into the substrate 10.

The circuitry 108 can include a capacitor connected in parallel with the coil 106. Together the coil 106 and the capacitor can form an LC resonant tank.

If monitoring of the thickness of a conductive layer on the substrate is desired, then when the magnetic field 150 reaches the conductive layer, the magnetic field 150 can pass through and generate an eddy-current in the layer on the substrate. This modifies the effective impedance of the LC circuit.

The drive and sense circuitry 108 can include a marginal oscillator coupled to a combined drive/sense coil 106, and the output signal can be a current required to maintain the peak to peak amplitude of the sinusoidal oscillation at a constant value, e.g., as described in U.S. Pat. No. 7,112,960. Other configurations are possible for the drive and sense circuitry 108. For example, separate drive and sense coils could be wound around the core. The drive and sense circuitry 108 can apply current at a fixed frequency, and the signal from the drive and sense circuitry 108 can be the phase shift of the current in the sense coil relative to the drive coil, or an amplitude of the sensed current, e.g., as described in U.S. Pat. No. 6,975,107.

Referring to FIG. 2, as the platen 24 rotates, the sensor 102 sweeps below the substrate 10. By sampling the signal from the circuitry 108 at a particular frequency, the circuitry 108 generates measurements at a sequence of sampling zones 94 across the substrate 10. For each sweep, measurements at one or more of the sampling zones 94 can be selected or combined. Thus, over multiple sweeps, the selected or combined measurements provide the time-varying sequence of values.

The polishing station 20 can also include a position sensor 96, such as an optical interrupter, to sense when the sensor 102 is underneath the substrate 10 and when the sensor 102 is off the substrate. For example, the position sensor 96 can be mounted at a fixed location opposite the carrier head 70. A flag 98 can be attached to the periphery of the platen 24. The point of attachment and length of the flag 98 is selected so that it can signal the position sensor 96 when the sensor 102 sweeps underneath the substrate 10. Alternately or in addition, the polishing station 20 can include an encoder to determine the angular position of the platen 24.

Returning to FIG. 1, a controller 90, e.g., a general purpose programmable digital computer, receives the signals from sensor 102 of the in-situ monitoring system 100. Since the sensor 102 sweeps beneath the substrate 10 with each rotation of the platen 24, information on the depth of the conductive layer, e.g., the bulk layer or conductive material in the trenches, is accumulated in-situ (once per platen rotation). The controller 90 can be programmed to sample measurements from the in-situ monitoring system 100 when the substrate 10 generally overlies the sensor 102.

In addition, the controller 90 can be programmed to calculate the radial position of each measurement, and to sort the measurements into radial ranges. By arranging the measurements into radial ranges, the data on the conductive film thickness of each radial range can be fed into a controller (e.g., the controller 90) to adjust the polishing pressure profile applied by a carrier head. The controller 90 can also be programmed to apply endpoint detection logic to the sequence of measurements generated by the in-situ monitoring system 100 signals and detect a polishing endpoint.

Since the sensor 102 sweeps underneath the substrate 10 with each rotation of the platen 24, information on the conductive layer thickness is being accumulated in-situ and on a continuous real-time basis. During polishing, the measurements from the sensor 102 can be displayed on an output device to permit an operator of the polishing station to visually monitor the progress of the polishing operation, although this is not required.

Figure 4A:
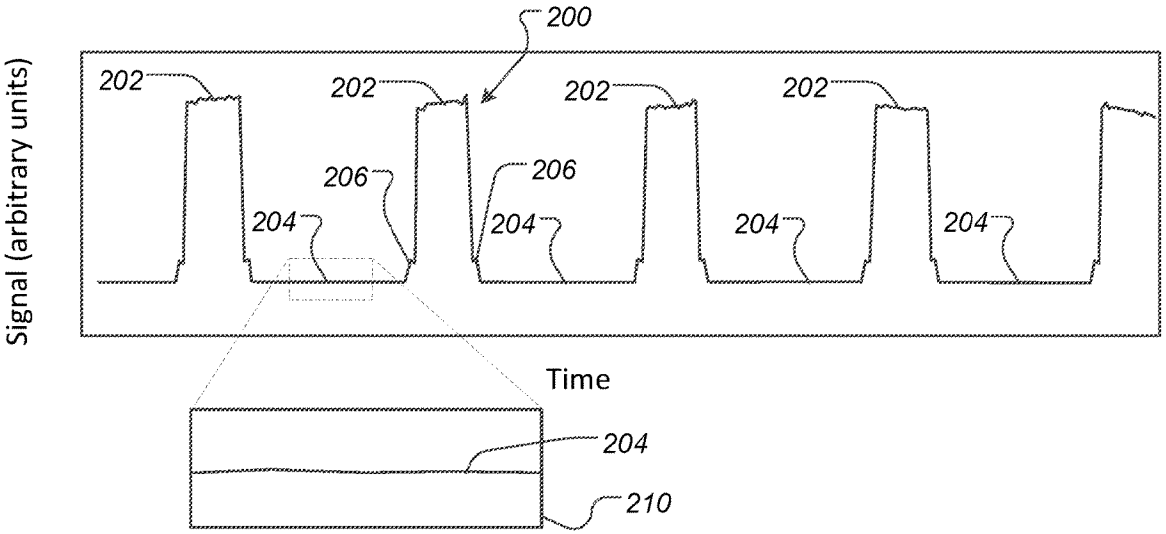
FIG. 4A is a schematic graph of a signal from the eddy current monitoring system.

FIG. 4A illustrates a graph of a signal 200 output by the eddy current monitoring system 100 as a function of time during a "normal" operation without unexpected mechanical vibration. The peaks 202 in the signal 200 correspond to measurements made when the sensor passes below the substrate 10; interaction of the magnetic field with the metal layer on the substrate and/or metal parts of the carrier head result in an increase in the signal strength. The peaks 202 have some amount of "noise" due to the sensor passing over various regions having different feature density, different metal depth, etc., that result in variations in signal strength.

In contrast, the valleys 204 in the signal 200 correspond to measurements made when the sensor is "off-substrate," i.e., not below the substrate. As shown in the expanded portion 210 of the graph, in the valley 204 the signal is generally flat and noise is low. With no metal layer on the substrate and/or metal parts of the carrier head for the magnetic field to interact with, the signal is generally at a minimum.

The "steps" 206 at the base of peaks 202 can correspond to the measurements made when the sensor passes below the retaining ring.

Figure 4B:
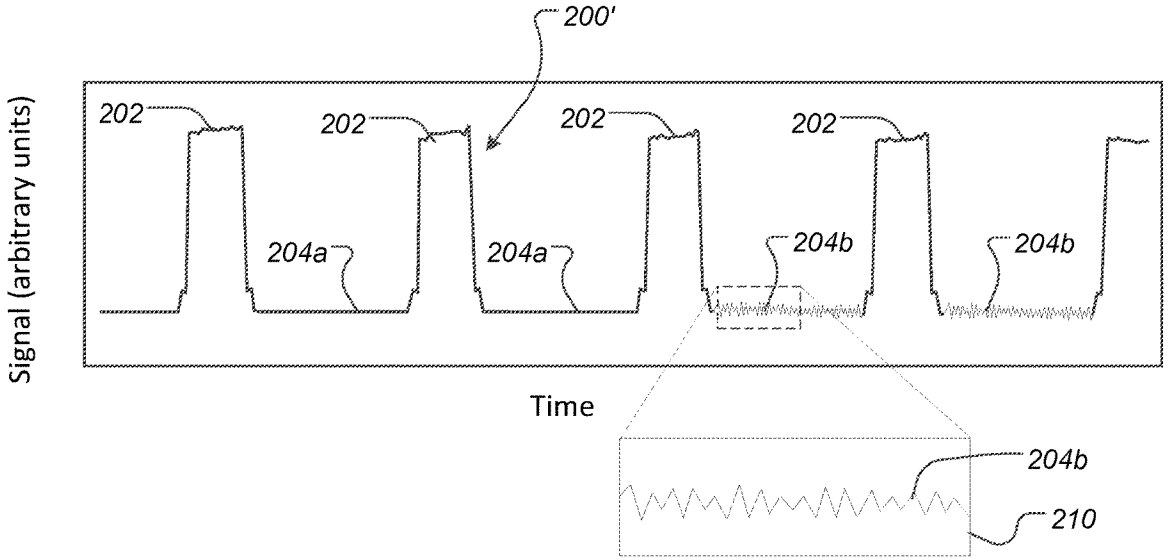
FIG. 4B is a schematic graph of a signal from the eddy current monitoring system when vibration occurs in the polishing system.

FIG. 4B illustrates a graph of a signal 200' output by the eddy current monitoring system 100 as a function of time during polishing process in which vibration develops, e.g., due to the stick-slip effect. Again, the peaks 202 in the signal 200' correspond to measurements made when the sensor passes below the substrate 10. For some processes, vibration may not occur immediately. Thus, initial valleys 204*a* may be generally flat and have low noise. However, when vibration occurs in the polishing system, it can manifest as noise in some subsequent valleys 204*b*. The vibration might occur due to changes in the polishing environment, e.g., accumulated heat in the polishing pad or slurry change in distribution over time. As there is effectively no metal over the sensor during the valley 204*b*, the appearance of noise in the valleys 204*b* is unexpected. Again without being limited to any particular theory, it is hypothesized that vibratory energy is transmitted into the sensor 102, causing the sensor 120 to vibrate relative to the platen 24 (see FIG. 1) such that the assembly departs from its calibration condition, resulting in a signal fluctuation.

Returning to FIG. 1, the controller 90 can be configured to detect an increase in noise or the presence of noise over a threshold amount in portions of the signal corresponding to the sensor 102 being located where no signal from metal above the polishing pad would be expected, i.e., not under the carrier head 70 (including the substrate 10 and the retaining ring 84), or under other metal components of the polishing system located adjacent and above the polishing pad that could induce a signal, e.g., not under a metal conditioning head 40 or conditioning disk 42. The positions for the sensor 102 where no signal from metal would be expected can be termed "off-metal" positions.

The controller 90 can select portions of the signal that correspond to the off-metal positions of the sensor 102 based on the data from the position sensor 96. For example, portions of the signal that correspond to the flag 98 can be excluded. Additional flags can be present for the conditioner head 40 and/or other metal components positioned above the polishing pad, and portions of the signal that correspond to those flags can also be excluded, so that the remainder of the signal corresponds to the "off-metal" positions. Alternatively or in addition, the controller can make the selection based on angular position data from the encoder, e.g., by comparing angular position from the encoder to a set of threshold values, e.g., from a look-up-table, that indicate which angular positions should be included or excluded. Alternatively or in addition, the controller can make the selection based on signal processing of the signal 200 to detect the peaks 202 (see FIGS. 4A-4B) which are then excluded.

Once the portion of the signal that correspond to the off-metal positions are selected, e.g., the valleys 204*a*, 204*b* are selected, "noise" in each portion can be measured. In general, one noise measurement can be generated per valley 204. A variety of techniques are possible to measure the noise of the off-metal portion of signal, such as standard deviation, min-max difference, or total trace length. Total trace length is a simple calculation, is sensitive to noise, and is generally not impacted by the substrate signal. As yet another possibility, the signal 200 can be subject to a Fourier transform to convert the signal into a frequency spectrum (a wavelength or wave number spectrum would be equivalent), and the power in a preselected portion of the spectrum, e.g., at 1-4 kHz, can be measured. Any of these techniques generate a measured value indicative of the noise in an off-metal portion of the signal.

The controller 90 can then compare the measured value to a stored threshold value. If the noise exceeds the threshold, the controller 90 can generate an alert signal. This could be a visual or audial signal for the operator so that the operator can decide to halt polishing. Alternatively, the alert signal could cause the controller 90 to automatically halt the polishing process. In either event, the operator can then take corrective action, e.g., adjust the polishing control parameters, e.g., slurry flow rate, carrier head pressure, or heat or coolant delivery, or replace parts, e.g., replace the retaining ring, to prevent non-uniform polishing in subsequent substrates.

Although the discussion above has focused on detection of mechanical vibration during a polishing operation, it would also be possible to use this technique for screening of processes and hardware, e.g., during "qualification" of a polishing system or polishing recipe. For example, the polishing system could be operated without a substrate present in the carrier head or with a "blank" substrate (rather than a device substrate intended for production of integrated circuits). If mechanical vibration is detected then the polishing system or polishing recipe is not considered qualified.

Figure 5:
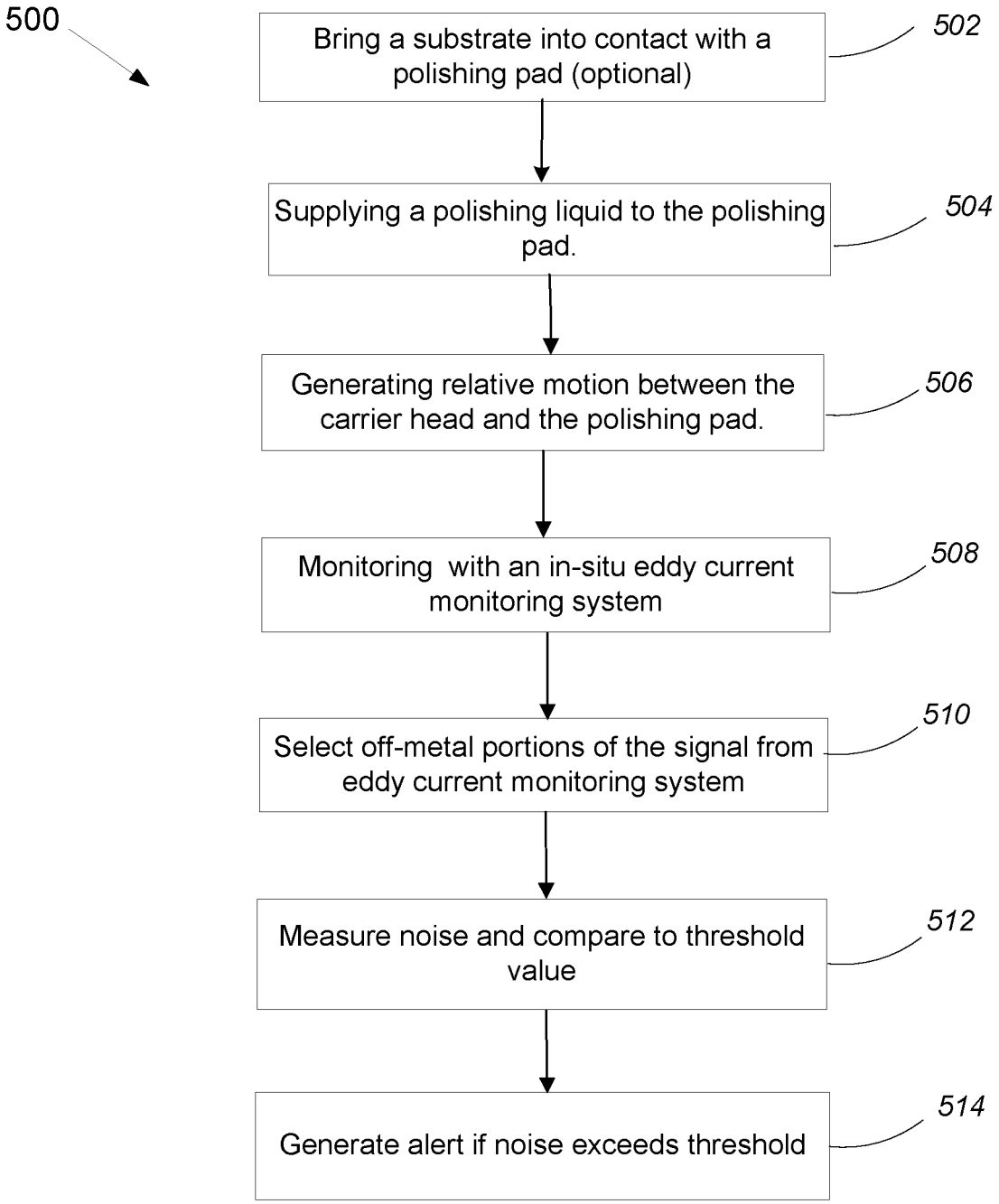
FIG. 5 is a flow diagram of a method for monitoring a conductive layer thickness.

FIG. 5 is a flow diagram of a method 500 for monitoring of mechanical vibration. Assuming that polishing of a substrate is desired (as opposed to a screening operation without a substrate), a substrate is placed in the carrier head and brought into contact with the polishing surface of a polishing pad (502). Even without the substrate, the retaining ring of the carrier head would contact the polishing pad. A polishing liquid (e.g., slurry) is supplied to the polishing pad (504), and relative motion is generated between the carrier head and the polishing pad (506), e.g., the platen is rotated. As this occurs, the system is monitored with an in-situ eddy current monitoring system (508) to generate a signal, e.g., a sequence of signal values. For polishing operations, portions of the signal that correspond to the sensor being below the substrate can be used to detect the thickness of a metal layer on the substrate and detect a polishing endpoint. Independently, portions of the signal that correspond to the sensor being in "off-metal" positions are selected (510). The noise in these "off-metal" portions of the signal is measured, and compared to a threshold value (512). If the measured noise exceeds a stored threshold value, an alert can be generated (514).

The above described polishing apparatus and methods can be applied in a variety of polishing systems. Either the polishing pad, or the carrier heads, or both can move to provide relative motion between the polishing surface and the substrate, so long as there are periods of time when the sensor is in an "off-metal" position. For example, the platen may orbit rather than rotate. The polishing pad can be a circular (or some other shape) pad secured to the platen. The polishing layer can be a standard (for example, polyurethane with or without fillers) polishing material, a soft material, or a fixed-abrasive material. Terms of relative positioning are used to refer to relative positioning within the system rather than with respect to gravity; it should be understood that the polishing surface and substrate can be held in a vertical orientation or some other orientation during the polishing operation.

Although the discussion above has focused on analysis of the "off-metal" portions of the signal, it is also possible to detect mechanical vibrations using the "on-metal" portions of the signal. In general, variations in the signal resulting from mechanical vibration will occur at a different frequency than variations resulting from the substrate, e.g., from patterned metal. Thus, the signal may filtered, e.g., a high-pass filter or band-pass filter, and the filtered signal can analyzed to determine whether to generate an alert. Specific frequency ranges for the filter can be determined empirically. Noise in the filtered signal can then be compared to a threshold to determine whether to generate an alert.

Functional operations of the controller 90 can be implemented using one or more computer program products, i.e., one or more computer programs tangibly embodied in a non-transitory computer readable storage media, for execution by, or to control the operation of, data processing apparatus, e.g., a programmable processor, a computer, or multiple processors or computers.

A number of embodiments of the invention have been described. Nevertheless, it will be understood that various modifications may be made without departing from the spirit and scope of the invention. Accordingly, other embodiments are within the scope of the following claims.

What is claimed is:

1. A polishing system, comprising:

a rotatable platen to hold a polishing pad;

a carrier head to hold a substrate in contact with the polishing pad;

a motor to rotate the rotatable platen;

an in-situ eddy current monitoring system including a sensor positioned in the rotatable platen such that the sensor sweeps beneath the carrier head with each rotation of the rotatable platen; and a controller configured to receive a signal from the in-situ eddy current monitoring system, select portions of the signal that correspond to off-metal positions of the sensor, the off-metal positions excluding at least positions of the sensor that are below the carrier head, measure noise in the selected portions of the signal that correspond to the off-metal positions of the sensor, and compare the measured noise to a threshold value to determine whether to generate an alert.

2. The polishing system of claim 1, wherein the controller is configured to generate an alert in response to the measured noise exceeding the threshold value.

3. The polishing system of claim 2, wherein the controller is configured to generate a visual or audio alert to an operator.

4. The polishing system of claim 1, wherein the controller is configured to compare the measured noise to the threshold value to determine whether to adjust a polishing parameter of the polishing system; and if the measured noise exceeds the threshold value, adjust the polishing parameter.

5. The polishing system of claim 1, wherein the controller is configured to halt polishing in response to the alert.

* * * * *